United States Patent [19]

Krueger

[11] Patent Number: 4,478,397

[45] Date of Patent: Oct. 23, 1984

[54] WORKPIECE SUPPORT STRUCTURE

[76] Inventor: William M. Krueger, 2027 N. 81st St., Omaha, Nebr. 68134

[21] Appl. No.: 362,760

[22] Filed: Mar. 29, 1982

[51] Int. Cl.[3] ..... B25B 1/10

[52] U.S. Cl. ..... 269/170; 269/221; 269/901

[58] Field of Search ..... 269/148, 147, 149, 221, 269/228, 224, 901, 139, 166-171.5, 88, 283; 144/286 R; 108/129

[56] References Cited

U.S. PATENT DOCUMENTS

| | | | |
|---|---|---|---|
| 1,112,192 | 9/1914 | Callan | 269/221 |
| 1,221,774 | 4/1917 | Taylor . | |
| 1,495,986 | 6/1924 | Bucci . | |
| 2,061,217 | 11/1936 | Watcher . | |
| 2,392,820 | 1/1946 | Heinrich . | |
| 2,617,457 | 11/1952 | Warwick . | |
| 2,681,841 | 6/1954 | Sperry | 108/129 |
| 2,724,201 | 11/1955 | Cavalero | 269/221 |
| 2,762,079 | 9/1956 | Morse | 269/224 |
| 2,952,280 | 9/1960 | Dorsey et al. . | |
| 2,955,819 | 10/1960 | Church . | |
| 3,342,226 | 9/1967 | Marcoux et al. | 144/286 R |
| 4,057,239 | 11/1977 | Hopf et al. . | |
| 4,074,898 | 2/1978 | Samuelson | 269/228 |
| 4,105,055 | 8/1978 | Brenta . | |
| 4,133,360 | 1/1979 | Sanfilippo et al. . | |
| 4,278,243 | 7/1981 | Alessio | 269/283 |
| 4,339,113 | 7/1982 | Vosper | 269/88 |
| 4,386,767 | 6/1983 | Dyckes et al. | 269/147 |

*Primary Examiner*—Robert C. Watson

*Attorney, Agent, or Firm*—Zarley, McKee, Thomte, Voorhees & Sease

[57] ABSTRACT

A workpiece support structure includes a pair of elongated beams supported in transversely spaced parallel relation by first and second foldable leg structures. A first clamp mechanism on the first leg structure supports a first transversely extended guide member. A second transversely extended guide member is carried on a pair of trolley wheel clamps equipped with disengageable clutch mechanisms for fixing the trolley wheel clamps at selected positions on the beams. Thus the second guide member is longitudinally movable to engage a workpiece between the first and second guide members whereupon the first clamp mechanism is applied to clamp the workpiece therebetween. The disengageable clutches of the trolley wheel clamps are interconnected by a transverse actuator rod so that the clutches are easily simultaneously operated by one hand of a worker. A novel toggle clamp includes a slide block for slidably supporting the plunger thereof on the adjacent beam and a slack adjustment screw for limiting the release stroke of the clamp.

26 Claims, 8 Drawing Figures

WORKPIECE SUPPORT STRUCTURE

BACKGROUND OF THE INVENTION

The present invention relates generally to apparatus for supporting a workpiece that is to be operated on, and more particularly to a workpiece support apparatus which is adapted to readily clamp either a very large or small workpiece yet which may be collapsed for very compact storage.

In recent years, several collapsible workbenches have become commercially available. These have been popular both because they are portable and collapsible for storage. Generally, the top surface is provided as some type of clamping means for supporting a workpiece on the table. An example is the workbench of U.S. Pat. No. 3,615,087.

The presently available collapsible workbenches have certain shortcomings, however, which limit their use. A primary problem is the limited size of workpiece which may be handled. The clamp jaws of these units can generally be opened only to a maximum extent of about 12 inches. Certainly such tables are ill-suited for cutting sheet lumber which is commonly provided in 4×8 foot sheets. Secondly, it is generally awkward and time consuming to operate the clamps of such workbenches because the only movable clamp jaw is controlled by a relatively slow cranking mechanism. Furthermore, since the movable clamp jaw is generally supported by a pair of spaced-apart clamps, both hands of the operator are required for operating the two clamps simultaneously.

These problems are believed to be resolved by the workpiece support structure of the present invention.

Accordingly, a primary object of the present invention is to provide an improved workpiece support structure.

Another object is to provide a workpiece support structure which is versatile for effective operation with both very large and small workpieces.

Another object is to provide a workpiece support structure which may be simply folded for compact storage.

Another object is to provide a workpiece support structure including a workpiece clamping system which may be quickly and easily applied and released.

A related object is to provide a workpiece support structure including a movable clamp jaw which is supported by a pair of clamps which may be simultaneously released and moved by an operator using only one hand.

Another object is to provide an improved beam clamp which is easily operated and movable on a beam.

Finally, an object of the invention is to provide a workpiece support structure which is simple and durable in construction, easy and efficient in operation and economical to manufacture.

These and other objects of the invention will be apparent in the following description.

SUMMARY OF THE INVENTION

The workpiece support structure of the present invention includes a pair of elongated beams arranged in spaced-apart parallel relation. A first folding leg structure is connected to one end of both beams and a second folding leg structure is connected to the opposite ends.

The legs are foldable to positions adjacent the plane of the beams for compact storage of the device.

A pair of toggle clamps are arranged in spaced-apart relation on the first folding leg structure. The plungers of the toggle clamps extend rearwardly toward the second folding leg structure and are interconnected by the first transversely extended guide member for engaging one side of a workpiece.

The other side of the workpiece is engaged by a second transversely extended guide member carried on a pair of beam clamps which are axially movable on the respective beams. Each beam clamp includes a trolley housing supported by rollers on a respective beam. Each trolley housing can be fixed in position by a disengageable clutch which is controlled by an upstanding clutch lever. An actuator arm extends transversely between the pair of clutch levers so that both clutches can be easily simultaneously disengaged by an operator using only one hand.

The elongated beams may be provided as lengths of standard plumbing pipe so that an operator could very inexpensively keep an inventory of pipes of various lengths to accommodate work on both large and small workpieces.

Whereas the workpiece support structure is light in weight and capable of compact storage, it can easily accommodate such large workpieces as 4×8 plywood sheets. The plywood is simply engaged against the first guide member whereupon the beam clamps are rolled forwardly to engage the second guide member against the opposite edge of the workpiece. The clamps on the first leg structure are then applied to rigidly hold the workpiece for any desired operation. Upon release of the clamps on the first leg structure, the workpiece can be removed whereupon the beam clamps may again be easily repositioned in unison with one hand to accommodate the next workpiece.

The invention may include improved toggle clamps having slack adjustment screws and spring loaded plungers to assure proper alignment of the first guide member.

DESCRIPTION OF THE PEFERRED EMBODIMENTS

Figure 1:
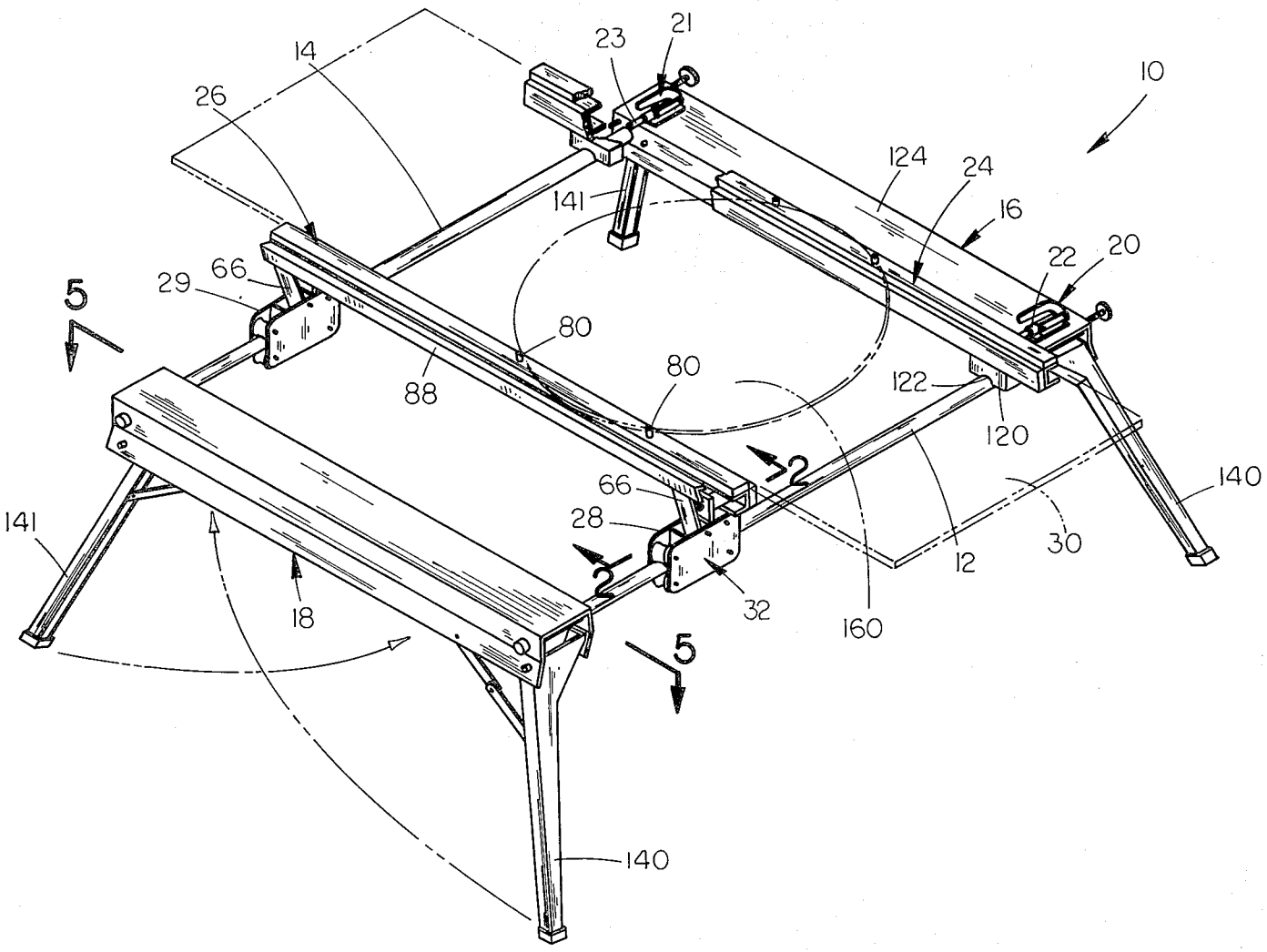
FIG. 1 is a perspective view of the workpiece support structure with dotted lines indicating both a rectangular and circular workpiece supported thereon.

The workpiece support structure 10 of the present invention is shown in FIG. 1 as including a pair of elongated beams 12 and 14 which are longitudinally extended in spaced-apart parallel relation between first and second leg structures 16 and 18.

A pair of toggle clamps 20 and 21 on the first leg structure 16 have rearwardly extended plungers 22 and 23 connected to opposite end portions of a first transversely extended guide member 24. A second transversely extended guide member 26 is connected to and extended between a pair of trolley wheel beam clamps 28 and 29 which are each axially movably supported on a respective beam 12 or 14.

A rectangular workpiece such as board 30 is easily positioned with one edge in engagement with the first guide member 24 whereupon the beam clamps 28 and 29 are moved forwardly in unison to engage the second guide member 26 against the opposite edge of board 30. By applying the toggle clamps 20 and 21, the workpiece is thus firmly clamped in position for any desired operation such as sawing, routing, drilling, etc. One need only release the toggle clamps whereupon the workpiece may be lifted from the structure and the second guide member may be repositioned to accommodate the next workpiece.

Figure 2:
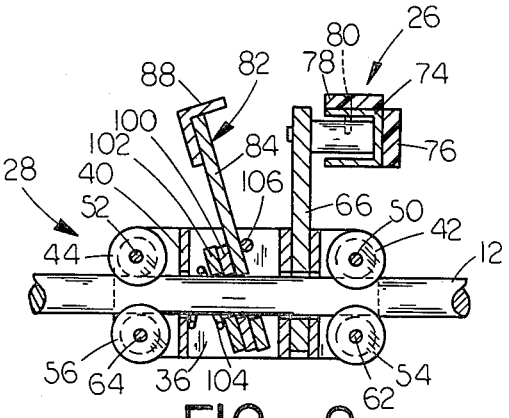
FIG. 2 is an enlarged side sectional view of the trolley wheel beam clamp with its disengageable clutch in an applied position, as seen on lines 2—2 in FIG. 1.
Figure 3:
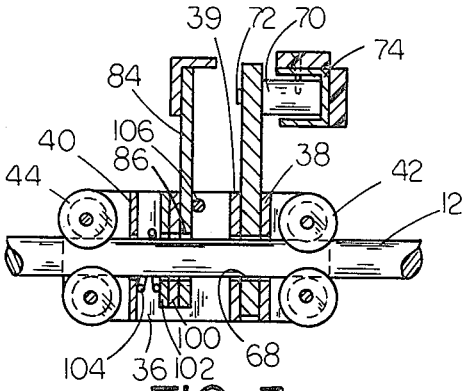
FIG. 3 is an enlarged side sectional view, similar to FIG. 2, but showing the disengageable clutch in a released position.
Figures 6, 7:
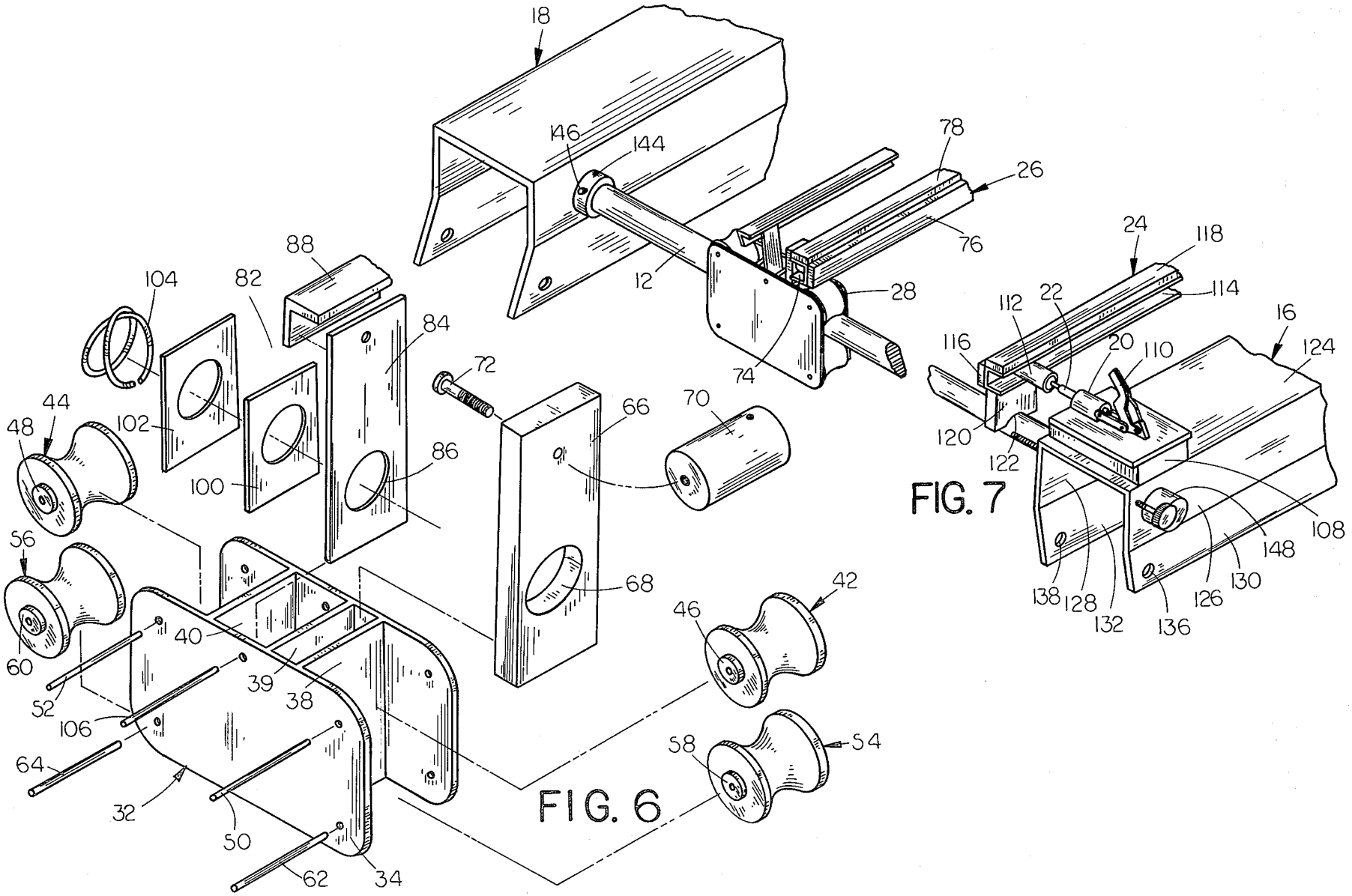
FIG. 6 is an exploded perspective view of the trolley wheel beam clamp.
FIG. 7 is a foreshortened partial perspective view of both the trolley beam clamp and spring loaded toggle clamp of the invention.

Since the trolley wheel clamps 28 and 29 are identical, only clamp 28 will be described in detail with like numerals referring to like parts of each. Referring to FIGS. 2, 3 and 6, trolley wheel beam clamp 28 includes a trolley housing 32 having a pair of elongated side walls 34 and 36 interconnected by transverse cross members 38, 39 and 40 which are provided with longitudinally aligned center openings through which beam 12 is extended as shown in FIGS. 2 and 3.

A pair of upper rollers 42 and 44 are rotatably supported by suitable bearings 46 and 48 on pins 50 and 52 which are extended through and supported in transversely aligned holes in the housing side walls as shown in FIG. 6. Likewise, a pair of lower rollers 54 and 56 are rotatably supported by suitable bearings 58 and 60 on pins 62 and 64 which are extended through and supported in transversely aligned holes in the housing side walls. The upper rollers 42 and 44 are vertically positioned for rolling engagement along the top surface of beam 12 with the lower rollers being positioned for rolling engagement along the underside of beam 12 such that the trolley housing is substantially constrained to fore and aft rolling movement along the beam. It is seen in FIG. 2 that the trolley housing is thus supported with the beam 14 disposed in clearance relation from the center openings of cross members 38, 39 and 40.

A guide member support arm 66 (FIGS. 2, 3 and 6) is press-fit or otherwise secured between housing cross members 38 and 39 with an oversize opening 68 aligned with the cross member openings for receiving the beam 12. A forwardly extended post 70 is connected to an upper portion of support arm 66, such as by bolt 72 for supporting second guide member 26. That guide member includes a rearwardly opening U-section channel 74 (FIG. 2) having an elongated jaw 76 secured to the forward face thereof and another elongated jaw 78 secured to the top flange thereof, such as by bolts 80 which may also serve to mount the channel 74 on posts 70. The top jaw 78 includes a plurality of transversely spaced openings for partially receiving upstanding dowel pins 80 (FIG. 1) for a purpose described hereinbelow.

The trolley beam clamp 28 may fixed onto the beam 12 by a disengageable clutch mechanism 82 which is arranged between housing cross members 39 and 40. Clutch 82 includes an upstanding clutch lever 84 having an oversize beam receiving opening 86 through a lower portion thereof and one end of an elongated actuator rod 88 connected to an upper portion thereof. The other end of the actuator rod is connected to the similar clutch lever 84 of the other trolley beam clamp 29. A pair of auxiliary clutch plates 100 and 102 having similar oversize openings may be positioned rearwardly of clutch lever 84 and a compression type actuator spring 104 is arranged between the clutch plate 102 and cross member 40 for urging the lower end portion of clutch lever 84 forwardly. A pin 106 extends transversely between the housing side walls to act as a stop which engages the clutch lever 84 above the opening 86 to limit forward movement of the upper portion of the clutch lever. Accordingly, the clutch lever 84 and clutch plates 100 and 102 are normally inclined upwardly and rearwardly for biting engagement of the edges of their oversize openings on the beam 12 as shown in FIG. 2.

To disengage clutch mechanism 82, an operator need only move actuator rod 88 forwardly toward second guide member 26 against the urging of spring 104, whereupon the clutch lever 84 and clutch plates are pivoted to upright positions with the edges of their oversize openings disengaged from the beam 12 as shown in FIG. 3. In this position, the trolley wheel clamp may be freely rolled forwardly or rearwardly on beam 12.

Figure 4:
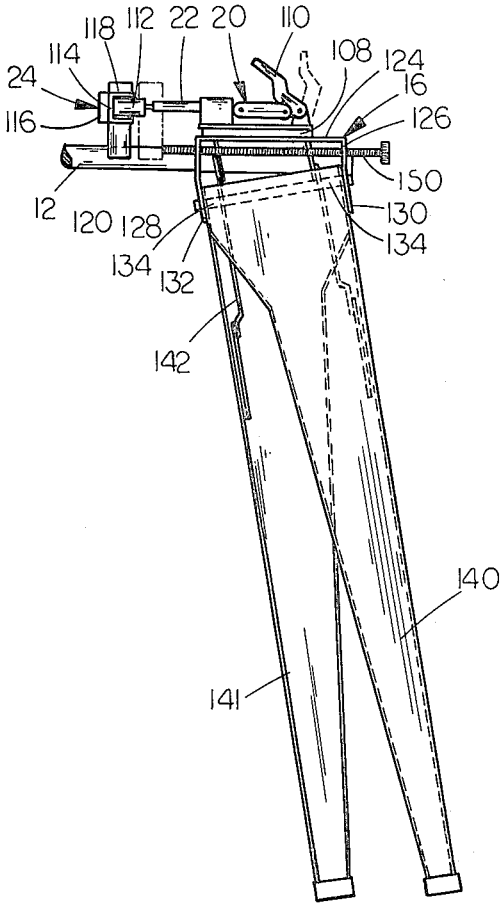
FIG. 4 is a partial side elevational view showing the table legs in their working position.

Toggle clamps 20 and 21 are also similar to one another so only clamp 20 will be described in detail with like numerals referring to like parts of each. Referring to FIG. 7, toggle clamp 20 may be a conventional push-pull type toggle clamp such as the commercially available DE-STA-CO Clamp Model 607, for example. The clamp 20 is elevated above the first leg structure 16 by a spacer block 108 and includes a rearwardly extended plunger 22 which is movable back and forth by pivotal movement of handle 110 as indicated in FIG. 4. A spring loaded plunger 112 is secured to the rearward end of plunger 22. The spring loaded plunger is likewise commercially available such as the DE-STA-CO Plunger-matic Model 905, for example, which requires 150 pounds of pressure to be completely compressed. The spring loaded plunger 112 is connected to one end of the first guide member 24, and specifically to a forwardly opening U-shaped channel 114 thereof having rearward and upper jaws 116 and 118 secured thereon.

To prevent bending of the plunger 22, a slide block 120 is fastened to the underside of channel 114 and includes a downwardly opening recess 122 which conforms to the cross sectional shape of beam 12 for sliding movement therealong.

Figure 5:
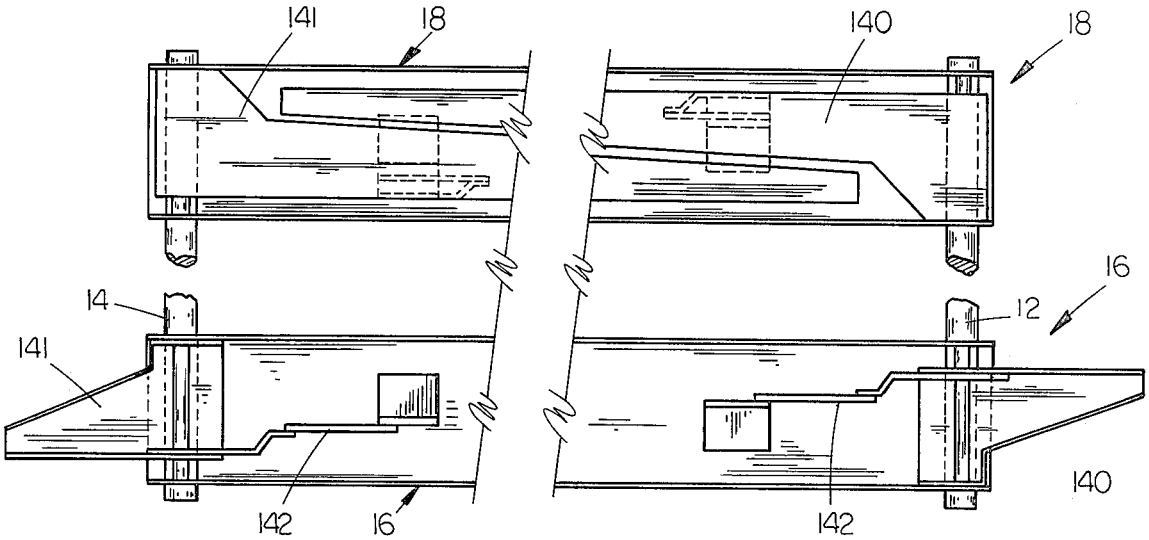
FIG. 5 is a partial foreshortened bottom view showing the working and storage positions of the foldable table legs.

Referring now to the first and second folding leg structures 16 and 18 of FIG. 5, this description will be directed primarily to the first folding leg structure 16 with like numerals referring to like parts of each. Folding leg structure 16 includes an elongated transversely extended frame 124 in the form of an open bottomed generally U-shaped channel having depending forward and rearward flanges 126 and 128 respectively, having longitudinally outwardly inclined lower portions 130 and 132 respectively. A pivot pin 134 extends through and between holes 136 and 138 for pivotally supporting an elongated leg 140. Leg 140 is pivotally movable between a storage position wherein it is generally horizontally disposed between flanges 126 and 128 as shown in FIG. 5 for second leg structure 18 and a working position wherein the leg is extended downwardly from frame 124 as shown in the lower portion of FIG. 5 for first leg structure 16. The working position is defined by the extent of pivotal movement permitted by the hinged braces 142. It can be seen in FIGS. 4 and 5 that the legs, in their working positions, are inclined downwardly and outwardly in both longitudinal and transverse directions from frame 124 for added stability. The legs also taper downwardly and are recessed along one edge to accommodate their adjacent seating within the frame 124 in their storage positions, as also shown in FIG. 5 for second leg structure 18.

The depending flanges 126 and 128 of each leg structure frame 124 include horizontally aligned openings adjacent the opposite ends thereof for slidably receiving the beams 12 and 14. A collar 144 may be fixed to one of the flanges and provided with a set screw 146 longitudinally fixing the respective leg structure on the beam or an end plug 148 (FIG. 7) may be secured onto the end of a beam to prevent sliding movement of the folding leg structure off the end of the beam.

In this regard, the beams 12 and 14 may be elongated tubular members and are preferably lengths of standard plumbing pipe. Accordingly, pairs of pipes of varying lengths may be kept and interchanged onto the folding leg structures for accommodating work on practically any size workpiece which can be manually loaded onto and removed from the structure 10. The rollers 42, 44, 54 and 56 of the trolley wheel beam clamps may thus be provided with generally arcuate concave engagement surfaces which conform to a portion of the transverse cross sectional shape of the pipes, thereby assuring that the trolley housings remain transversely centered relative to the beams.

Since the trolley beam clamps 28 and 29 afford the primary adjustment of the spacing between the first and second guide members 24 and 26, the toggle clamps 20 and 21 are primarily used just to apply the final clamping pressure to a workpiece already engaged between the first and second guide members. Accordingly, the full range of fore and aft movement for the toggle clamp plungers is not necessary and in fact, could result in misalignment of the first guide member. For this purpose, each toggle clamp 20 and 21 includes a slack adjustment screw 150 (FIGS. 4 and 7) which is extended through longitudinally aligned holes in the leg structure flanges 126 and 128. Screw 150 is preferably slidable through and oversize opening in forward flange 126 and threadably engaged in an opening in rearward flange 128 so as to be longitudinally adjustable therein. Accordingly, the rearward end of screw 150 is adjusted to a position for engagement with a respective slide block 120 to limit forward movement of the first guide member 24 to the dotted line position indicated in FIG. 4.

Figure 8:
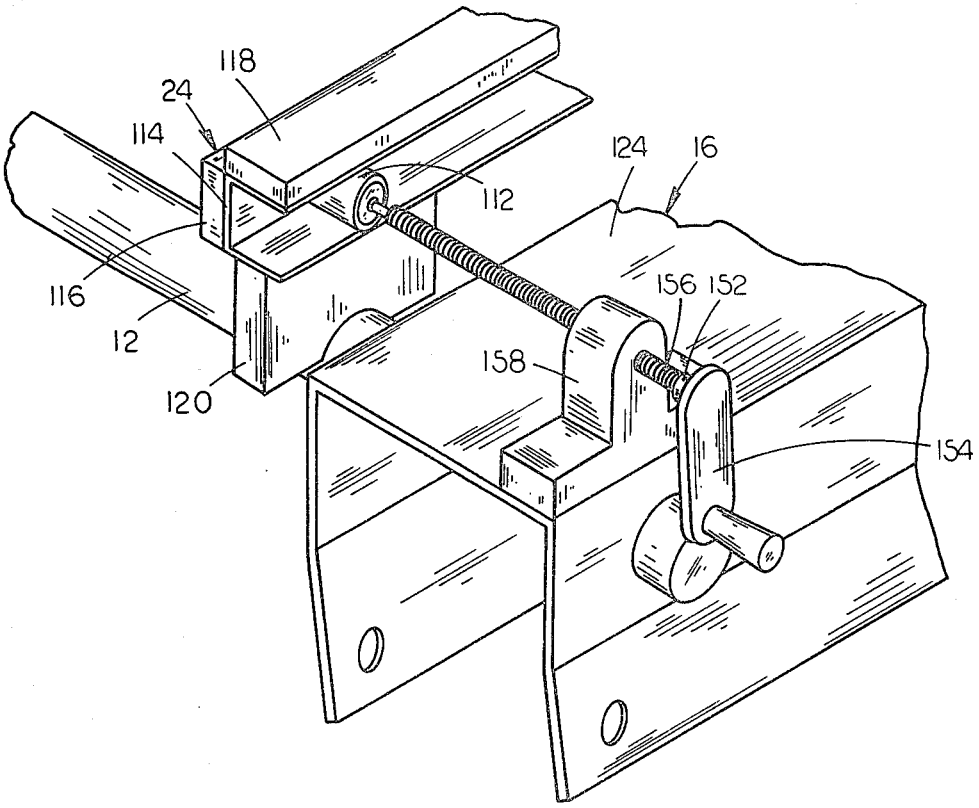
FIG. 8 is a perspective view of an alternate cranktype clamp for the first guide member.

If preferred, the toggle clamps on the first leg structure may be replaced with crank-type clamps 152 such as that shown in FIG. 8 wherein a crank handle 154 is rotatable to axially adjust threaded shaft 156 relative to a fixed base 158.

In operation, the operator need only grip the second guide member 26 with one hand at a generally central position and in a manner to draw the actuator rod 88 forwardly toward the guide member for releasing the clutch mechanisms 82. The second guide member may then be freely adjusted forwardly or rearwardly to engage a workpiece between the first and second guide members. As shown in FIG. 1, a rectangular workpiece is preferably supported on the top surfaces of the vertically disposed jaws 76 and 116 with the interior surface of the horizontally disposed jaws 78 and 118 applying the clamping forces. An irregular shaped or circular workpiece, such as that indicated at 160 in FIG. 1, is simply rested on the top surface of horizontal jaws 78 and 118 with the dowel pins 80 being relied upon to apply the clamping forces.

Once the second guide member 126 is adjusted to engage the workpiece between the first and second guide members, the operator need only engage the toggle clamps 20 and 21 to firmly clamp the workpiece for any desired operation. Likewise, a finished workpiece is easily removed from the structure by simply disengaging toggle clamps 20 and 21 and freely lifting the workpiece from the structure.

Whereas preferred embodiments of the invention have been shown and described herein, it will be apparent to those skilled in the art that many modifications, substitutions and alterations may be made which are within the intended broad scope of the appended claims. For industrial applications, for example, it may be desired to substitute air or hydraulic clamps for the toggle clamps and the leg structures need not be collapsible if only a stationary jig is required.

Thus there has been shown and described an improved workpiece support structure which accomplishes at least all the stated objects.

I claim:

1. A workpiece support structure, comprising, a pair of elongated beams having forward and rearward ends, first and second leg structures connected to said beams in longitudinally spaced-apart relation for supporting said beams in clearance relation above a support surface, said first leg structure being positioned forwardly of said second leg structure, and each leg structure including an elongated frame means extended transversely between said beams, first clamp means mounted on said first leg structure, a first transversely extended guide member connected to said first clamp means for rearward movement toward said second leg structure in response to application of said first clamp means, a second clamp means axially movably mounted on said beams, and a second transversely extended guide member connected to said second clamp means for longitudinal movement therewith relative to said beams, said second clamp means being releasably applicable to resist rearward movement whereby a workpiece engaged between said first and second guide members may be clamped therebetween upon application of said first clamp means, and each leg structure including a pair of legs pivotally connected to said frame means for movement between storage positions generally parallel to said frame means and working positions extended downwardly from said frame means.

2. The structure of claim 1 wherein said second clamp means comprises a pair of beam clamps, each movably mounted on a respective one of said beams.

3. The structure of claim 1 wherein said first clamp means comprises a pair of toggle clamps arranged in transversely spaced-apart relation.

4. The structure of claim 3 wherein each of said toggle clamps includes a rearwardly extended plunger, a slide block connected to the rearward end of said plunger and slidably engaged on a top surface of a respective beam, and said first transversely extended guide member being connected to and extended between said slide blocks.

5. The structure of claim 4 wherein each of said toggle clamps further comprises a longitudinally extended slack adjustment screw having a rearward end engageable with the respective slide block to limit forward movement of the slide block when the toggle clamp is released.

6. The structure of claim 4 wherein said rearwardly extended plunger includes a spring loaded rearward end portion including a compression spring means whereby said rearward end portion is movable forwardly relative to said plunger against the urging of said compression spring means.

7. The structure of claim 1 wherein said first clamp means comprises a pair of crank clamps arranged in transversely spaced relation, each crank clamp including a base secured to said first leg structure, a longitudinally extended shaft threadably connected to said base, a crank connected to a forward end of said shaft and said first guide member connected to a rearward end of said shaft.

8. The structure of claim 7 wherein said rearward end of said shaft comprises a spring loaded plunger including a compression spring means whereby said plunger is movable forwardly relative to said rearward end against the urging of said compression spring means.

9. The structure of claim 1 wherein said beams comprise elongated tubular members.

10. The structure of claim 9 wherein said beams comprise lengths of standard plumbing pipe.

11. The structure of claim 1 further comprising elongated jaws mounted on said first and second guide members for engaging a workpiece therebetween.

12. The structure of claim 11 wherein said jaws include a plurality of dowel pin openings adapted for partially receiving upstanding dowel pins between which a workpiece may be supported.

13. The structure of claim 1 wherein each leg includes upper and lower ends, the lower end, in the working position, being displaced both longitudinally and transversely outwardly of said upper end.

14. The structure of claim 13 wherein said elongated frame means comprises an open bottomed inverted generally U-shaped channel having depending flanges with pairs of aligned beam receiving openings for slidably receiving said pair of beams.

15. The structure of claim 14 wherein said legs are longitudinally positioned between the depending flanges of said channel member.

16. The structure of claim 1 wherein said leg structures are longitudinally slidably mounted on said beams.

17. The structure of claim 16 wherein said beams include plugs on the opposite ends thereof to prevent sliding movement of said folding leg structures off the ends of said beams.

18. A workpiece support structure, comprising, a pair of elongated beams having forward and rearward ends, first and second leg structures connected to said beams in longitudinally spaced-apart relation for supporting said beams in clearance relation above a support surface, said first leg structure being positioned forwardly of said second leg structure, and each leg structure including an elongated frame means extended transversely between said beams, first clamp means mounted on said first leg structure, a first transversely extended guide member connected to said first clamp means for rearward movement toward said second leg structure in response to application of said first clamp means, a second clamp means axially movably mounted on said beams, and a second transversely extended guide member connected to said second clamp means for longitudinal movement therewith relative to said beams, said second clamp means being releasably applicable to resist rearward movement whereby a workpiece engaged between said first and second guide members may be clamped therebetween upon application of said first clamp means, said second clamp means comprising a pair of beam clamps, each movably mounted on a respective one of said beams, and each beam clamp comprising a trolley housing having forward and rearward ends, roller means on said housing and engaging top and bottom surfaces of a respective beam to substantially constrain said housing to fore and aft rolling movement along said beam, a guide member support arm extended upwardly from said housing and connected to said second transversely extended guide member for supporting said second guide member relative to said housing, and a disengageable clutch means operatively associated with said housing and engageable with said beam to prevent rearward movement of said trolley housing at times.

19. The structure of claim 18 wherein said roller means comprises a pair of longitudinally spaced-apart upper rollers mounted on said housing for rotation about transverse axes and engaging a top surface of a respective beam for supporting said trolley housing thereon, and at least one lower roller mounted on said housing for rotation about a transverse axis and engaging a bottom surface of said respective beam.

20. The structure of claim 19 wherein said roller means comprises a pair of lower rollers disposed in vertically aligned relation below said upper rollers.

21. The structure of claim 19 wherein said rollers have a concave engagement surface which conforms to a transverse cross section of said respective beam.

22. The structure of claim 18 wherein said disengageable clutch means comprises an upstanding clutch means comprises an upstanding clutch lever having upper and lower portions and an oversize beam receiving opening therebetween for supporting said clutch lever on said beam with freedom of fore and aft rocking movement thereon, stop means on said housing and engageable with said clutch lever above said oversize opening to limit forward movement of the upper portion of said clutch lever, spring means operative to urge the lower portion of said clutch lever forwardly whereby upon engagement of said upper portion with said stop means, said clutch lever is inclined upwardly and rearwardly for biting engagement of an edge of said oversize opening on said beam.

23. The structure of claim 22 further comprising an elongated actuator arm connected to and extended transversely between the upper portions of the clutch levers of said pair of beam clamps.

24. The structure of claim 23 wherein said second transversely extended guide member is positioned forwardly of said actuator arm whereby upon forward movement of said actuator arm toward said second guide member against the urging of said spring means, said clutch levers are pivoted to generally upright positions thereby providing freedom of rolling movement in opposite directions for said beam clamps.

25. The structure of claim 22 further comprising at least one auxiliary clutch plate having a similar oversize beam receiving opening and being arranged between said clutch plate and spring means.

26. The structure of claim 18 wherein said housing comprises a pair of elongated side walls interconnected by transverse cross members, said roller means being arranged between said side walls.

* * * * *